US011292644B2

(12) United States Patent
Conceicao et al.

(10) Patent No.: US 11,292,644 B2
(45) Date of Patent: Apr. 5, 2022

(54) DISPENSING CLOSURE

(71) Applicant: Johnson & Johnson Consumer Inc., Skillman, NJ (US)

(72) Inventors: Guaraci Conceicao, Sao Paulo (BR); Carlos Eduardo Lopes, Sao Paulo (BR); Nivea Simoes, Sao Paulo (BR)

(73) Assignee: Johnson & Johnson Consumer Inc., Skillman, NJ (US)

( * ) Notice: Subject to any disclaimer, the term of this patent is extended or adjusted under 35 U.S.C. 154(b) by 0 days.

(21) Appl. No.: 17/002,840

(22) Filed: Aug. 26, 2020

(65) Prior Publication Data

US 2021/0061527 A1 Mar. 4, 2021

Related U.S. Application Data

(60) Provisional application No. 62/894,058, filed on Aug. 30, 2019.

(51) Int. Cl.
*B65D 47/20* (2006.01)
*B65D 1/02* (2006.01)

(52) U.S. Cl.
CPC ..... *B65D 47/2012* (2013.01); *B65D 1/0246* (2013.01); *B65D 2255/20* (2013.01)

(58) Field of Classification Search
CPC .. B65D 47/08; B65D 47/2012; B65D 1/0246; B65D 2255/20; B65D 35/22; B65D 47/2006
USPC ..... 222/556, 546, 129; 220/525, 832, 831, 220/810; 215/243, 237, 235
See application file for complete search history.

(56) References Cited

U.S. PATENT DOCUMENTS

| | | | | |
|---|---|---|---|---|
| 2,361,958 | A | 11/1944 | Nyden | |
| 2,365,110 | A | 12/1944 | Rogers | |
| 4,346,823 | A | 8/1982 | Eppenbach | |
| 4,693,399 | A | 9/1987 | Hickman et al. | |
| 4,955,513 | A | 9/1990 | Bennett | |
| 5,054,662 | A | 10/1991 | Santagiuliana | |
| 5,503,309 | A * | 4/1996 | Oder | B65D 47/2006 222/534 |
| 5,676,282 | A | 10/1997 | Satterfield | |
| 5,695,097 | A | 12/1997 | Rollinghoff | |
| 5,730,322 | A | 3/1998 | Iba et al. | |
| 5,765,725 | A * | 6/1998 | Matt | B65D 35/22 222/129 |
| 8,028,865 | B2 | 10/2011 | DeJonge | |
| D732,958 | S | 6/2015 | Peneda | |

(Continued)

FOREIGN PATENT DOCUMENTS

| | | |
|---|---|---|
| DE | 29906976 U1 | 8/2000 |
| DE | 29906978 U1 | 8/2000 |

OTHER PUBLICATIONS

International search report and written opinion dated Jan. 12, 2021, for International application PCT/IB2020/057963.

*Primary Examiner* — Vishal Pancholi
*Assistant Examiner* — Robert K Nichols, II

(57) ABSTRACT

A closure for a container having an opening for dispensing fluids contained therein. The closure includes a cap and a pivotable top component moveable between a closed and two opened positions. A pair of dispensing openings are in fluid communication with the associated container. A second dispensing opening and its associated channel has a larger cross section, perpendicular to a flow direction, than a first dispensing opening and its associated channel.

8 Claims, 7 Drawing Sheets

(56) References Cited

U.S. PATENT DOCUMENTS

| | | | | |
|---|---|---|---|---|
| 9,676,529 | B2 | 6/2017 | Cavalier | |
| 2002/0179644 | A1* | 12/2002 | Evans | B65D 50/046 222/153.14 |
| 2014/0284353 | A1* | 9/2014 | Wear | B65D 47/0838 222/129 |

* cited by examiner

DISPENSING CLOSURE

CROSS-REFERENCE TO RELATED APPLICATIONS

This application claims the benefit of U.S. provisional application 62/894058 filed on Aug. 30, 2019, the complete disclosure of which is hereby incorporated herein by reference for all purposes.

BACKGROUND OF THE INVENTION

Field of the Invention

The present invention relates to a device for containing and dispensing materials, particularly suited to be used with bottles or containers holding liquids, for instance, cosmetics, liquid soaps, shampoos, sun lotions and the like. More particularly, this invention relates to two-way dispenser closures with openings of different cross-sections for dispensing the container contents at different rates.

Description of Related Art

Closures for dispensing fluids from containers of liquid, such as shampoos, lotions, or sunscreens are available on the market. Types of dispensing closures, that are known include flapper closures, side pour closures, spice closures, sifters, disc top closures, turret closures, Yorker closures, snap top closures, and more. Lotion pumps are also useful for health and beauty applications.

The closure forms a dispenser for liquids which can be easily operated by the user. Many known dispensing closures have a single liquid dispensing pathway that the user opens by lifting or twisting a portion of the closure.

There are also numerous dispensing closures have more than one liquid dispensing pathway. These also are operated by the user at the time of dispensing liquid from the container.

Issues such as leakage and product remaining exposed in closure passages call for closures which are designed to avoid these issues.

BRIEF SUMMARY OF THE INVENTION

One aspect of the invention relates to a closure for a container having an opening for dispensing fluids contained therein. The closure includes a cap and a pivotable top component moveable between a closed and two opened positions. The cap includes a base plate arranged and configured to seal the opening of the associated fluid container and a pair of apertures. Each of the apertures is defined by a cylindrical tube extending from the base plate and in fluid communication with the associated container. The pivotable top component is mounted on the cap for pivotable motion about a horizontal hinge axis. It includes a top plate and pair of dispensing pathways aligned with the cylindrical tubes of the cap. Each dispensing pathway has a cylindrical plug extending from the top plate being sized to sealingly engage the inner surface of the associated cylindrical tube of the cap, a cylindrical sleeve extending from the top plate being sized to sealingly engage the outer surface of the associated cylindrical tube of the cap, a channel from an annular void between the cylindrical plug and cylindrical sleeve to a dispensing opening. Each dispensing opening is in fluid communication with the cylindrical tube and thereby the associated container. A second dispensing opening and associated channel has a larger cross section, perpendicular to a flow direction, than a first dispensing opening and associated channel.

A second aspect of the invention relates to a closure for a container having an opening for dispensing fluids contained therein. The closure includes a cap and a pivotable top component moveable between a closed and two opened positions. The cap has an outer surface, an inner surface, a base plate arranged and configured to seal the opening of the associated fluid container, and a centrally disposed aperture defined by a cylindrical tube extending from a top surface of the base plate and in fluid communication with the associated container. The pivotable top component is mounted on the cap for pivotable motion about a horizontal hinge axis. It has a top plate, a pivotable top component rim, a cylindrical plug extending from the top plate being sized to sealingly engage the inner surface of the cylindrical tube of the cap, a cylindrical sleeve extending from the top plate being sized to sealingly engage the outer surface of the associated cylindrical tube of the cap, a first channel from an annular void between the cylindrical plug and cylindrical sleeve to a first dispensing opening, and a second channel from an annular void between the cylindrical plug and cylindrical sleeve to a second dispensing opening. The dispensing openings are in fluid communication with the cylindrical tube and thereby the associated container, and the second dispensing opening and associated channel has a larger cross section, perpendicular to a flow direction, than the first dispensing opening and associated channel.

DETAILED DESCRIPTION OF THE INVENTION

Figure 1:
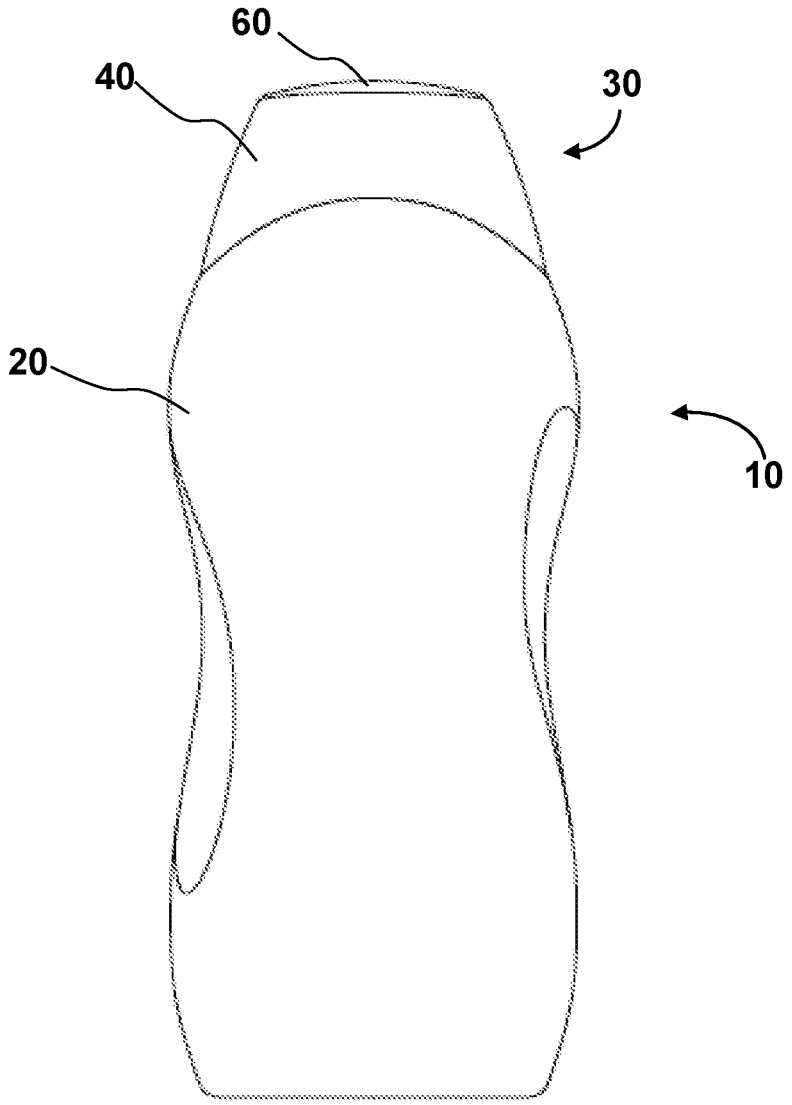
FIG. 1 is a side view of an embodiment of a fluid dispensing bottle of the present invention.

The present invention relates to relates to two-way dispenser closures with openings of different cross-sections for dispensing the container contents at different rates.

The presently disclosed subject matter will now be described more fully hereinafter with reference to the accompanying drawings and examples, in which representative embodiments are shown. The presently disclosed subject matter can, however, be embodied in different forms and should not be construed as limited to the embodiments set forth herein. The subject matter of our invention should be accorded the widest scope consistent with the features described herein. These embodiments are provided so this disclosure will be thorough and complete, and will fully convey the scope of the embodiments to those skilled in the art. Unless otherwise defined, all technical and scientific terms used herein have the same meaning as commonly understood by one of ordinary skill in the art to which this presently described subject matter belongs.

As used herein the specification and the claims, the term "container", also known as bottle, flagon, flask, jug or vial, an object that can be used to hold or transport liquids, solids, or gases. In the present invention, the container and the closure are independent entities.

The container closure described herein has several openings for dispensing fluids from the container at different rates. The closure has two parts, a cap and a pivotable top component. The cap has a base plate configured to seal the opening of the fluid container, and a pair of cylindrical tube apertures extending from the base plate which are in fluid communication with the contents of the container. The pivotable top component, moveable between a closed and two opened positions, is mounted on the cap for pivotable motion about a horizontal hinge axis and has a top plate and pair of dispensing pathways aligned with the cylindrical tubes of the cap. The dispensing pathways has cylindrical plugs (preferably hollow) extending from the top plate which are sized to sealingly engage the inner surface of the associated cylindrical tube of the cap, as well as cylindrical sleeves extending from the top plate being sized to sealingly engage the outer surface of the associated cylindrical tube of the cap. A pair of channels is formed by annular voids between the cylindrical plugs and cylindrical sleeves which lead to a pair of dispensing openings, wherein the dispensing openings are in fluid communication with the cylindrical tube and thereby the associated container. To allow for dispensing the container contents at different rates, the first dispensing opening and associated channel has a smaller cross section, perpendicular to a flow direction, than a second dispensing opening and associated channel The two-way dispenser closure is designed to be attached to a container which contains a substance, preferably the top of the container. The substance may be a liquid including consumer products such as soaps, shampoos, sunscreens, lotions, cosmetics, and the like.

Referring now to the drawings wherein like reference numerals designate corresponding parts throughout the several views, FIG. 1 illustrates a side view of an embodiment of a fluid dispensing bottle 10 of the present invention. Dispensing bottle 10 includes a container 20 and a closure 30. Container 20 may be made of glass, metal, or plastic, in different shapes, colors, and sizes. Plastics include, but are not limited to, polyethylene terephthalate (PET), High-Density Polyethylene (HDPE), Polyvinyl Chloride (PVC), Low-Density Polyethylene (LDPE), or Polypropylene (PP). Plastics such as HDPE or LDPE are especially useful if dispensing bottle 10 is a squeeze bottle. A squeeze bottle is a type of bottle for dispensing a fluid, that is powered by squeezing the container through pressure exerted, e.g., by the user's hand. Its fundamental characteristic is that manual pressure applied to a resilient container is harnessed to compress fluid within it and thereby expel the fluid from the bottle.

Figure 2:
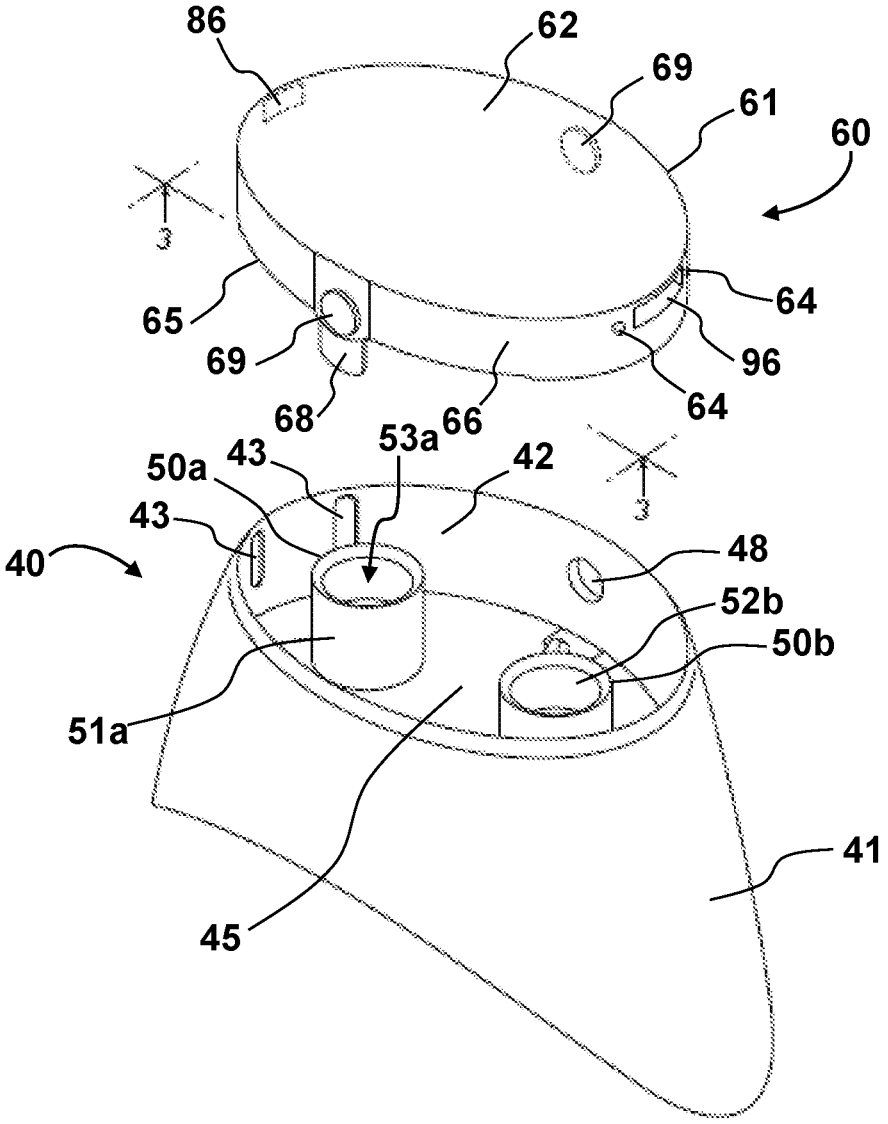
FIG. 2 is an exploded perspective view of a first embodiment of a container closure of the present invention, showing a pivotable top component embodiment, and a cap embodiment.

Closure 30 has two parts, a cap 40 and a pivotable top component 60. FIG. 2 is an exploded perspective view of a first embodiment of a container closure 30, showing a pivotable top component embodiment 60, and a cap embodiment 40.

Figure 3:
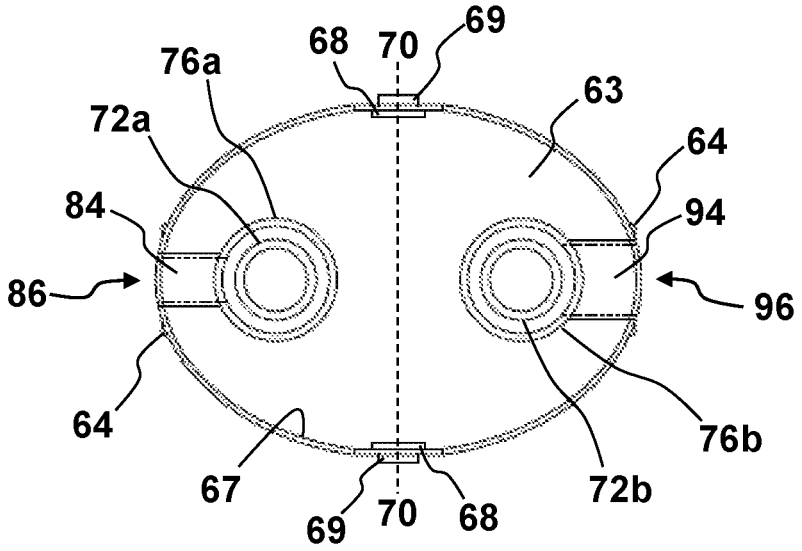
FIG. 3 is a bottom view of the pivotable top component embodiment of FIG. 2.

Pivotable top component 60, shown in perspective view in FIG. 2, and in bottom view in FIG. 3, has a top plate 61, a pivotable top component rim 65, a rocker arm 68, a pin 69, a first dispensing opening 86, and a second dispensing opening 96. Top plate 61 has a first surface 62 and a second surface 63. Pivotable top component rim 65 has a first surface 66 and a second surface 67. Protrusions 64 are disposed on second surface 67 of pivotable top component rim 65.

FIG. 3 also shows a first channel 84 and a second channel 94, as well as a horizontal hinge axis 70, cylindrical plugs 72*a*, 72*b* and cylindrical sleeves 76*a*, 76*b*. Cylindrical plugs 72*a*, 72*b* and cylindrical sleeves 76*a*, 76*b* extend from second surface 63 of top plate 61. The figure also shows that second dispensing opening 96 and associated second channel 94 have larger cross sections, perpendicular to a flow direction, than first dispensing opening 86 and associated channel first channel 84.

While the first channel 84 and second channel 94 are shown with substantially rectangular cross-sections, other cross-sections are contemplated including other quadrilateral forms (e.g., trapezoidal, square, and the like), triangular, continuous curves (e.g., circular, oval, and the like), and slots (having a width dimension substantially larger than a height dimension and with curved or substantially squared-off ends).

The cross-sectional area can be selected to dispense the contents of the container at a desired rate. For example, first dispensing opening 86 and associated channel first channel 84 may have a cross-sectional area of approximately 40% to 75% of a corresponding cross-sectional area of the second dispensing opening 96 and associated second channel 94. Preferably, the cross-sectional area of the first dispensing opening 86 and associated channel first channel 84 is approximately 60% to 70% of a corresponding cross-sectional area of the second dispensing opening 96 and associated second channel 94.

In one preferred embodiment, first dispensing opening 86 has a rectangular cross-section of 2 mm by 4 mm, and the second dispensing opening 96 has rectangular cross-section of 2 mm by 6 mm. Thus, the cross-sectional area of the first dispensing opening 86 is approximately 67% of a corresponding cross-sectional area of the second dispensing opening 96.

Horizontal hinge axis 70, as will be shown subsequently, provides the pivot axis for pivotable top component 60.

Figure 4:
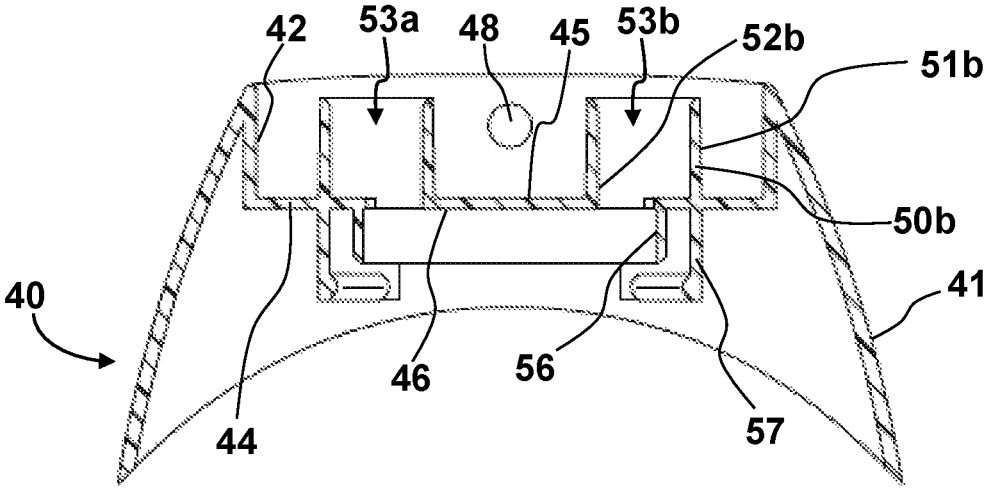
FIG. 4 is a section view of the cap embodiment of FIG. 2.
Figure 5:
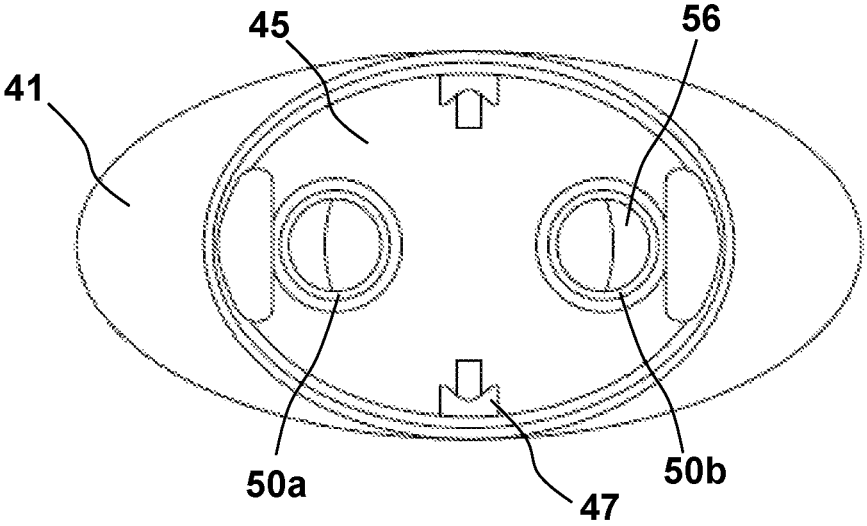
FIG. 5 is a top view of the cap embodiment of FIG. 2.

Cap 40, shown in perspective view in FIG. 2, in section view in FIG. 4, and in top view in FIG. 5, has an outer surface 41, an inner surface 42, a base plate 44, a rocker arm stabilizer 47, and a pin receiver 48. Protrusion guides 43 are blind holes disposed on inner surface 42 of cap 40. Rocker arm stabilizer 47, guides and limits the pivot path of the rocker arm 68, acting as a support point in the opening movement that releases first dispensing opening 86 and second dispensing opening 96. Base plate 44 has a top surface 45 and a bottom surface 46, a pair of cylindrical tubes 50*a*, 50*b* extending from top surface 45 of base plate 44, a container sealing ring 56, and a snap fit 57. Apertures 53*a* and 53*b* are defined by a cylindrical tube 50*a* and cylindrical tube 50*b*, respectively.

As seen in FIGS. 2 and 3, pivotable top component 60 includes protrusions 64 disposed next to each dispensing opening (86, 96). Cap 40 includes protrusion guides 43 disposed on cap inner surface 42. In this embodiment, protrusion guides 43 are racetrack shaped, having two lateral sides, and two vertical ends.

When cap 40 and a pivotable top component 60 are coupled together to form the closure 30, protrusions 64 are disposed inside their respective protrusion guides 43. The length of protrusion guides 43 is sufficient to allow the displacement of protrusions 64 during the movement of pivotable top component 60, and functions to provide guidance to the motion of pivotable top component 60. In addition, the end of the protrusion guides 43 are stop blocks when the pivotable top component 60 reaches its open position.

Closure 30 is designed to be attached to the top of container 20. Sealing ring 56 and snap fit 57 extend from bottom surface 46 of base plate 44. Snap fit 57 is the means of attaching closure 30 to container 20, and sealing ring 56 is a means of preventing leakage of the substance (e.g. liquid) disposed in container 20. Although a snap fit is described here as the means of attaching closure 30 to container 20, other means, such as screw threads or adhesives may also be used. The seal between closure 30 and container 20 may, in some embodiments, include a gasket.

Cylindrical tubes 50*a*, 50*b* extending from top surface 45 of base plate 44, each have an outer surface 51*a* and 51*b*, respectively, and an inner surface 52*a* and 52*b*, respectively. Cylindrical tubes 50*a*, 50*b*, as mentioned above, define a pair of apertures 53*a*, 53*b* through base plate 44. Apertures 53*a*, 53*b* are in fluid communication with the contents of container 20.

Figure 6:
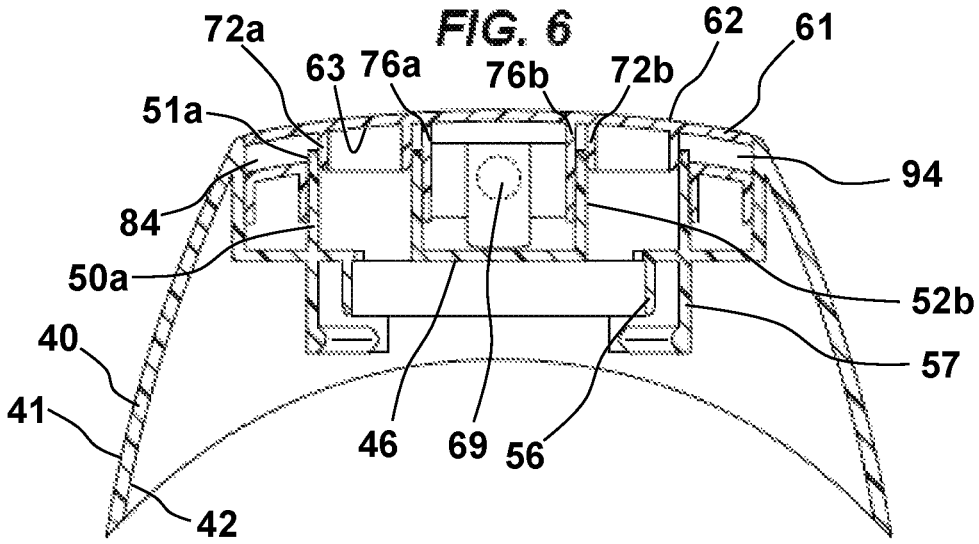
FIG. 6 is a section view of the assembled first closure embodiment in the closed position.
Figure 7:
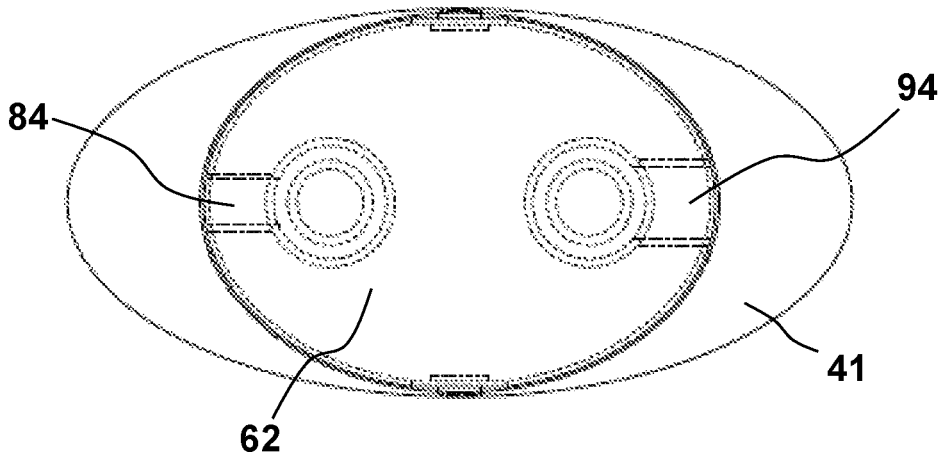
FIG. 7 is a top view of the assembled first closure embodiment in the closed position.

FIGS. 6 and 7 show views of the first embodiment of assembled closure 30. FIG. 6 is a section view of assembled closure 30, and FIG. 7 is a top view of assembled closure 30 when closure 30 is in the closed position. The figures show cylindrical plugs 72*a*, 72*b* which extend from second surface 63 of top plate 61, are sized to sealingly engage inner surfaces 52*a* and 52*b*, respectively, of the associated cylindrical tubes 50*a*, 50*b* of cap 40. Cylindrical sleeves 76*a*, 76*b*, which also extend from second surface 63 of top plate 61, are sized to sealingly engage outer surfaces 51*a* and 51*b*, respectively, of the associated cylindrical tubes 50*a*, 50*b* of cap 40. The result is that when closure 30 is in the closed position, there is no pathway for the substance disposed in container 20 to be dispensed from fluid dispensing bottle 10.

Figure 8:
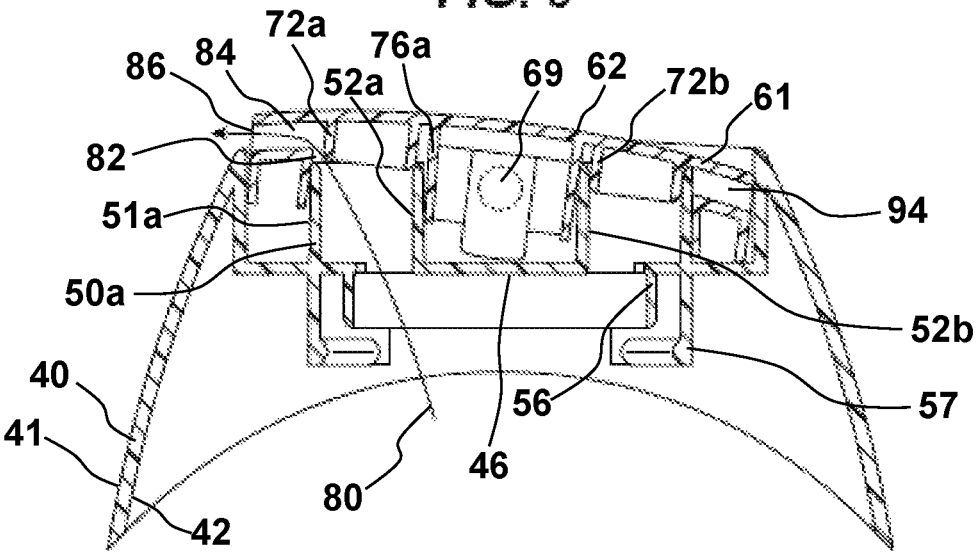
FIG. 8 is a section view of the assembled first closure embodiment in the first opened position.
Figure 9:
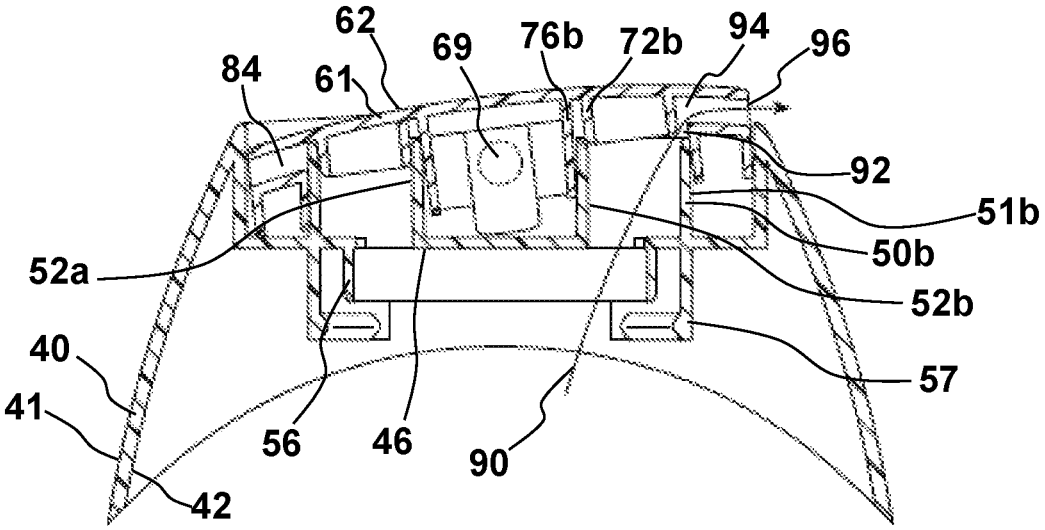
FIG. 9 is a section view of the assembled first closure embodiment in the second opened position.

FIGS. 8 and 9 show section view of the first embodiment assembled closure 30. FIG. 8 is a section view of assembled closure 30 when closure 30 is in a first opened position. FIG. 9 is a section view of assembled closure 30 when closure 30 is in a second opened position. In each opened position, pivotable top component 60 has been pivoted about horizontal hinge axis 70. In the first opened position, the pivot is in the clockwise direction, while in the second opened position, the pivot is in the counterclockwise direction.

In FIG. 8 (the first opened position), cylindrical plug 72*a*, which is associated with first channel 84 and first dispensing opening 86, has been displaced so that cylindrical plug 72*a* is no longer sealingly engage with inner surface 52*a* of cylindrical tube 50*a*. Cylindrical sleeves 76*a*, 76*b* remain sealingly engage with outer surfaces 51*a*, 51*b* of cylindrical tubes 50*a*, 50*b*, respectively. Also, cylindrical plug 72*b* associated with second channel 94 and second dispensing opening 96, remains sealingly engage with inner surface 52*b* of cylindrical tube 50*b*. First annular void 82 is formed. The result is that when closure 30 is in the first opened position, first dispensing pathway 80 is created, and the substance disposed in container 20 passes through first channel 84 and is dispensed from fluid dispensing bottle 10 through first dispensing opening 86.

In FIG. 9 (the second opened position), cylindrical plug 72*b*, which is associated with second channel 94 and second dispensing opening 96, has been displaced so that cylindrical plug 72*b* is no longer sealingly engage with inner surface 52*b* of cylindrical tube 50*b*. Cylindrical sleeves 76*a*, 76*b* remain sealingly engage with outer surfaces 51*a*, 51*b* of cylindrical tubes 50*a*, 50*b*, respectively. Also, cylindrical plug 72*a* associated with first channel 84 and first dispensing opening 86, remains sealingly engage with inner surface 52*a* of cylindrical tube 50*a*. Second annular void 92 is formed. The result is that when closure 30 is in the second opened position, second dispensing pathway 90 is created, and the substance disposed in container 20 passes through second channel 94 and is dispensed from fluid dispensing bottle 10 through second dispensing opening 96.

As mentioned earlier second dispensing opening 96 and associated second channel 94 have larger cross sections, perpendicular to a flow direction, than first dispensing opening 86 and associated channel first channel 84. This allows for more substance to be dispensed from fluid dispensing bottle 10 when closure 30 is in the second opened position than when it is in the first opened position. If dispensing bottle 10 is a squeeze bottle, then a similar amount of manual pressure applied to container 20 yields more substance from fluid dispensing bottle 10 when closure 30 is in the second opened position than when it is in the first opened position.

In some embodiments, indicia may be disposed on first surface 62 of top plate 61 of pivotable top component 60 near first dispensing opening 86 and second dispensing opening 96 to indicate that more substance will disperse from fluid dispensing bottle 10 when closure 30 is in the second opened position than when it is in the first opened position.

Figure 10:
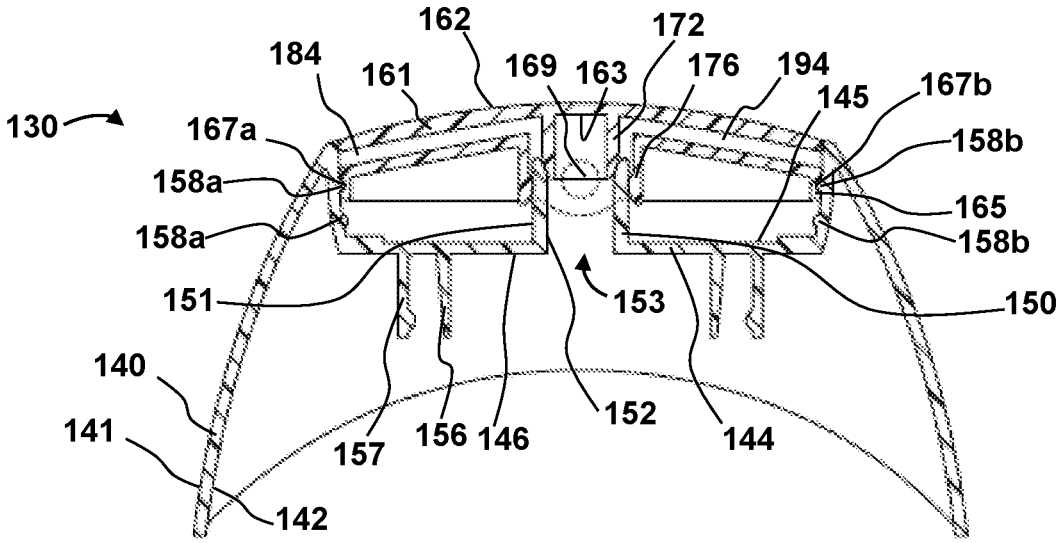
FIG. 10 is a section view of an assembled second closure embodiment in the closed position.
Figure 11:
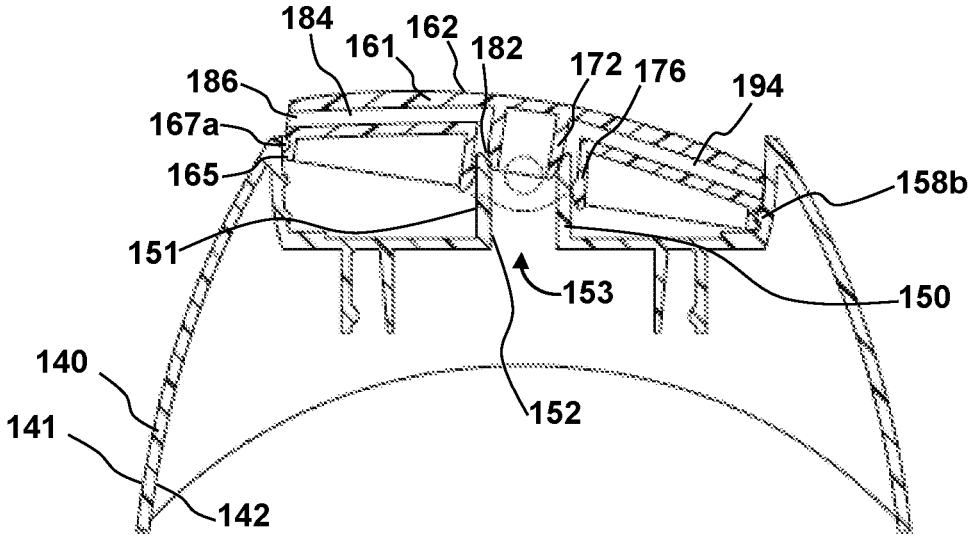
FIG. 11 is a section view of the assembled second closure embodiment in the first opened position.

FIGS. 10 and 11 show views of an assembled second closure embodiment. FIG. 10 is a section view of an assembled closure 130 in the closed position, while FIG. 11 is a section view of assembled closure 130 in a first opened position. As with the first embodiment, closure 130 has a cap 140 and a pivotable top component. Cap 140 has an outer surface 141, an inner surface 142, and a base plate 144.

Base plate 144 has a top surface 145 and a bottom surface 146, a cylindrical tube 150 extending from top surface 145 of base plate 144, protrusions 158*a*, 158*b* extending from outer surface 141 of base plate 144, a container sealing ring 156, and a snap fit 157. Aperture 153 is defined by cylindrical tube 150.

Sealing ring 156 and snap fit 157 extend from bottom surface 146 of base plate 144. Snap fit 157 attaches closure 130 to a container, and sealing ring 156 prevents leakage of the substance (e.g. liquid) disposed in the container. Although a snap fit is described here, screw threads or adhesives may also be used to attach closure 130 to a container, and the seal between closure 130 and the container may, in some embodiments, include a gasket.

Cylindrical tube 150, extending from top surface 145 of base plate 144 has an outer surface 151 and an inner surface 152. Cylindrical tube 150, as mentioned above, defines an aperture 153 through base plate 144. Aperture 153 is in fluid communication with the contents of the container.

The pivotable top component portion of cap 140 has a top plate 161, a pivotable top component rim 165, a pin 169, a first dispensing opening 186, a first channel 184 and a second channel 194. The pivotable top component also has a rocker arm and a second dispensing opening (not shown).

Top plate 161 has a first surface 162 and a second surface 163. Cylindrical plug 172 and cylindrical sleeve 176 extend from second surface 163 of top plate 161.

Pivotable top component rim 165 has a pair of notches 167*a,b*.

Although not shown on the figures, the second dispensing opening and associated second channel 194 have larger cross sections, perpendicular to a flow direction, than first dispensing opening 186 and associated channel first channel 184.

Also not shown in the figures is a horizontal hinge axis which provides the pivot axis for pivotable top component. In each opened position, the pivotable top component is pivoted about the horizontal hinge axis. In the first opened position, the pivot is in the clockwise direction, while in the second opened position, the pivot is in the counterclockwise direction.

FIG. 10 shows a section view of the second embodiment of assembled closure 130 in the closed position. The figure shows cylindrical plug 172, which extends from second surface 163 of top plate 161, are sized to sealingly engage inner surface 152 of cylindrical tube 150 of cap 140. Cylindrical sleeve 176, which also extend from second surface 163 of top plate 161, is sized to sealingly engage outer surface 151 of cylindrical tube 150 of cap 140. The result is that when closure 130 is in the closed position, there is no pathway for the substance disposed in the container to be dispensed from fluid dispensing bottle.

FIG. 11 shows a section view of the second embodiment assembled closure 130 when closure 130 is in a first opened position. In the opened position, to pivotable top component has been pivoted about horizontal hinge axis (not shown in the figure). In the first opened position, the pivot is in the clockwise direction. In a second opened position, the pivot would be in the counterclockwise direction.

In FIG. 11, cylindrical plug 172, which is associated with first channel 184 and first dispensing opening 186, has been displaced so that cylindrical plug 172 is no longer sealingly engage with inner surface 152 of cylindrical tube 150. Cylindrical sleeve 176 remain sealingly engage with outer surface 151 of cylindrical tube 150. First annular void 182 is formed. The result is that when closure 130 is in the first opened position, a first dispensing pathway is created, and the substance disposed in the container passes through first channel 184 and is dispensed from the fluid dispensing bottle through first dispensing opening 186.

Though not shown, second embodiment assembled closure 130 may be pivoted in the counterclockwise direction to a second opened position, forming a second annular void, a second dispensing pathway, and the substance disposed in the container would pass through second channel 194 and be dispensed from the fluid dispensing bottle through a second dispensing opening.

The present invention will be further understood by reference to the following specific Examples which are illustrative of the composition, form and method of producing the present invention. It is to be understood that many variations of composition, form and method of producing this would be apparent to those skilled in the art. The following Examples, wherein parts and percentages are by weight unless otherwise indicated, are only illustrative.

EXAMPLES

Example 1: Formation and Assembly of Fluid Dispensing Bottle

Containers with openings sized to fit closures of the present invention were formed by blow molding. The containers were made of High-Density Polyethylene (HDPE). The capacity of the molded containers was 200 mL.

First embodiment container closures of the present invention were made by injection molding. Caps and pivotable top components were molded separately out of Polypropylene (PP), and then manually assembled to form container closures. The first dispensing openings had rectangular cross-sections which were 2 mm by 4 mm. The second dispensing openings had rectangular cross-sections which were 2 mm by 6 mm. Containers and closures were manually assembled to form fluid dispensing bottles.

What is claimed is:

1. A closure for a container having an opening for dispensing fluids contained therein comprising:

a) a cap comprising a base plate arranged and configured to seal the opening of the associated fluid container and a pair of apertures, each aperture defined by a cylindrical tube extending from the base plate and in fluid communication with the associated container, and b) a pivotable top component moveable between a closed and two opened positions, said pivotable top component:

i) mounted on the cap for pivotable motion about a single horizontal hinge axis and ii) comprising a top plate and pair of dispensing pathways aligned with the cylindrical tubes of the cap; each dispensing pathway comprising a cylindrical plug extending from the top plate being sized to sealingly engage the inner surface of the associated cylindrical tube of the cap, a cylindrical sleeve extending from the top plate being sized to sealingly engage the outer surface of the associated cylindrical tube of the cap, a channel from an annular void between the cylindrical plug and cylindrical sleeve to a dispensing opening, wherein the horizontal hinge axis is disposed between the pair of dispensing pathways, wherein the dispensing opening is in fluid communication with the cylindrical tube and thereby the associated container, wherein a second dispensing opening and associated channel has a larger cross section, perpendicular to a flow direction, than a first dispensing opening and associated channel.

2. The closure of claim 1 wherein the first and second dispensing openings have substantially rectangular openings.

3. The closure of claim 1 wherein the first dispensing opening cross section, perpendicular to a flow direction, has an area of about 40% to about 75% of the second dispensing opening cross section, perpendicular to a flow direction.

4. The closure of claim 3 wherein the first dispensing opening cross section, perpendicular to a flow direction, has an area of about 60% to about 70% of the second dispensing opening cross section, perpendicular to a flow direction.

5. A closure for a container having an opening for dispensing fluids contained therein comprising:

a) a cap comprising an outer surface, an inner surface, a base plate arranged and configured to seal the opening of the associated fluid container, and a centrally disposed aperture defined by a cylindrical tube extending from a top surface of the base plate and in fluid communication with the associated container, and b) a pivotable top component moveable between a closed and two opened positions, said pivotable top component:

i) mounted on the cap for pivotable motion about a single horizontal hinge axis and ii) comprising A) a top plate, B) a pivotable top component rim, C) a cylindrical plug extending from the top plate being sized to sealingly engage the inner surface of the cylindrical tube of the cap, D) a cylindrical sleeve extending from the top plate being sized to sealingly engage the outer surface of the associated cylindrical tube of the cap, E) a first channel from an annular void between the cylindrical plug and cylindrical sleeve to a first dispensing opening, and F) a second channel from an annular void between the cylindrical plug and cylindrical sleeve to a second dispensing opening;

wherein the horizontal hinge axis is aligned with the cylindrical plug, wherein the dispensing openings are in fluid communication with the cylindrical tube and thereby the associated container, and the second dispensing opening and associated channel has a larger cross section, perpendicular to a flow direction, than the first dispensing opening and associated channel.

6. The closure of claim 5 wherein the first and second dispensing openings have substantially rectangular openings.

7. The closure of claim 5 wherein the first dispensing opening cross section, perpendicular to a flow direction, has an area of about 40% to about 75% of the second dispensing opening cross section, perpendicular to a flow direction.

8. The closure of claim 7 wherein the first dispensing opening cross section, perpendicular to a flow direction, has an area of about 60% to about 70% of the second dispensing opening cross section, perpendicular to a flow direction.

* * * * *